US008727474B2

(12) United States Patent
Hatano

(10) Patent No.: US 8,727,474 B2
(45) Date of Patent: May 20, 2014

(54) INKJET PRINTER AND CORRECTION VALUE ACQUISITION METHOD

(71) Applicant: Dainippon Screen Mfg. Co., Ltd., Kyoto (JP)

(72) Inventor: Keiji Hatano, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 13/734,057

(22) Filed: Jan. 4, 2013

(65) Prior Publication Data

US 2013/0215176 A1 Aug. 22, 2013

(30) Foreign Application Priority Data

Feb. 22, 2012 (JP) ..... P2012-036320

(51) Int. Cl.
*B41J 2/12* (2006.01)

(52) U.S. Cl.
USPC ..... 347/14; 347/15; 347/78

(58) Field of Classification Search
USPC ..... 347/14, 15, 19, 43, 78, 131, 183
See application file for complete search history.

(56) References Cited

U.S. PATENT DOCUMENTS 5,552,810 A 9/1996 Matsuo ..... 347/19
6,832,825 B1 * 12/2004 Nishikori et al. ..... 347/19
6,871,931 B2 * 3/2005 Kaneko ..... 347/19

FOREIGN PATENT DOCUMENTS

JP 6-166247 6/1994

* cited by examiner

*Primary Examiner* — Thinh Nguyen
(74) *Attorney, Agent, or Firm* — Ostrolenk Faber LLP

(57) ABSTRACT

In an inkjet printer, a pattern for density correction that indicates a constant density image is printed on printing paper with a head having a plurality of outlet rows, and pattern image data that indicates the pattern is acquired. A target outlet that ejects ink toward a linear region having a missing part in the pattern is detected, and a reference outlet that is included in the same outlet row as the target outlet and located close to the target outlet is specified. A density correction value of the target outlet among density correction values that are acquired based on a density profile of the pattern is replaced with a representative value of a density correction value of the reference outlet. Through this, even if an ink ejection failure occurs in any of the outlets, appropriate density correction values can be obtained for a plurality of outlets.

16 Claims, 7 Drawing Sheets

INKJET PRINTER AND CORRECTION VALUE ACQUISITION METHOD

TECHNICAL FIELD

The present invention relates to an inkjet printer and a correction value acquisition method.

BACKGROUND ART

Conventionally, inkjet printers that print an image by ejecting fine droplets of ink from a plurality of outlets of a head toward printing paper while moving the printing paper relative to the head have been used. Also, a pattern for density correction that indicates a constant density image has been printed on printing paper with a plurality of outlets and the distribution of densities in the image on the printing paper has been measured so as to acquire a plurality of density correction values of the outlets and achieve uniform print densities of the outlets using the density correction values (so-called shading compensation). For example, Japanese Patent Application Laid-Open No. 6-166247 discloses a method in which, in addition to a pattern A for use in detecting unevenness of the recording density of a recording head, a pattern B that is printed by driving only a specified recording element is formed simultaneously so that the positions of the recording elements and the detected density data are always properly associated with each other, which alleviates head shading.

Incidentally, with inkjet printers, ink ejection failures (also called "failing nozzles" or "missing dots") may arise due to clogged outlets caused by ink hardening or adherence of debris such as paper dust or due to the effect of air bubbles in the ink inside the head. In this case, part of the printed image may be faint, or so-called "whiteout regions" on which no ink is deposited may appear. If an ink ejection failure occurs in any of a plurality of outlets when (at the time of or during) printing a pattern for density correction on printing paper, appropriate density correction values for the outlets cannot be acquired. In this case, it is necessary to perform cleaning processing and then re-print the pattern for density correction, thus taking a long time to acquire density correction values.

SUMMARY OF INVENTION

The present invention is intended for an inkjet printer, and it is an object of the present invention to acquire appropriate density correction values of a plurality of outlets in a short time even if an ink ejection failure occurs in any of the outlets.

The inkjet printer according to the present invention includes a head in which a plurality of outlet rows, each having outlets arranged in an arrangement direction, are arranged in a direction perpendicular to the arrangement direction, a scanning mechanism that moves a base material relative to the head in a scanning direction that intersects with the arrangement direction, a control part that controls ink ejection from the head so that a plurality of outlets of the head form dots at a plurality of positions in a width direction on a base material, the width direction being perpendicular to the scanning direction, outlets that are adjacent to each other in each outlet row having disposed therebetween one outlet from each of the other outlet rows with respect to the width direction, an image pickup part that captures an image printed on a base material; and a correction value acquisition part that acquires a plurality of density correction values of the plurality of outlets. Under control of the control part, a pattern for density correction that indicates a constant-density image is printed on a base material with the plurality of outlets. The image pickup part acquires image data that indicates the pattern for density correction on the base material. The correction value acquisition part includes a target outlet detection part that detects a target outlet based on the image data, the target outlet being an outlet that ejects ink toward a linear region that extends in the scanning direction and has a missing part in the pattern for density correction on the base material, a reference outlet specification part that specifies at least one reference outlet that is an outlet included in the same outlet row as the target outlet and located close to the target outlet, and a correction value calculation part that obtains the plurality of density correction values that are used by the control part to control ink ejection from the head by replacing a density correction value of the target outlet among density correction values that are acquired based on a density profile with a representative value of a density correction value of the at least one reference outlet, the density profile indicating a change in density values in the width direction in the density correction pattern, or obtains the plurality of density correction values that are used by the control part to control ink ejection from the head, based on a density profile that is obtained by replacing a density value of the linear region with a representative value of a density value at a position in the width direction at which the at least one reference outlet ejects ink.

According to the present invention, appropriate density correction values of the plurality of outlets can be acquired in a short time even if an ink ejection failure occurs in any of the outlets.

In a preferable mode of the present invention, a check pattern having linear portions formed with ink ejected from respective outlets is printed together with the pattern for density correction on the base material, the image data indicating the pattern for density correction and the check pattern on the base material is acquired, and the target outlet detection part detects the target outlet based on an extent to which each linear portion is missing in the check pattern. This enables accurate detection of the target outlet.

In another preferable mode of the present invention, the target outlet detection part detects an outlet that ejects ink toward a region adjacent to the linear region as another target outlet. As a result, even if the linear region having a missing part affects the acquisition of the density value of a region adjacent to the linear region, an appropriate density correction value can be acquired for the outlet that ejects ink toward that region.

According to an aspect of the present invention, a plurality of density correction values that are acquired when a pattern for density correction is printed are used to print a next pattern for density correction, and the correction value acquisition part updates the plurality of density correction values of the plurality of outlets based on image data that indicates the next pattern for density correction. Accordingly, more preferable density correction values can be acquired.

The present invention is also intended for a correction value acquisition method of acquiring density correction values of a plurality of outlets in an inkjet printer.

These and other objects, features, aspects and advantages of the present invention will become more apparent from the following detailed description of the present invention when taken in conjunction with the accompanying drawings.

DESCRIPTION OF EMBODIMENTS

Figure 1:
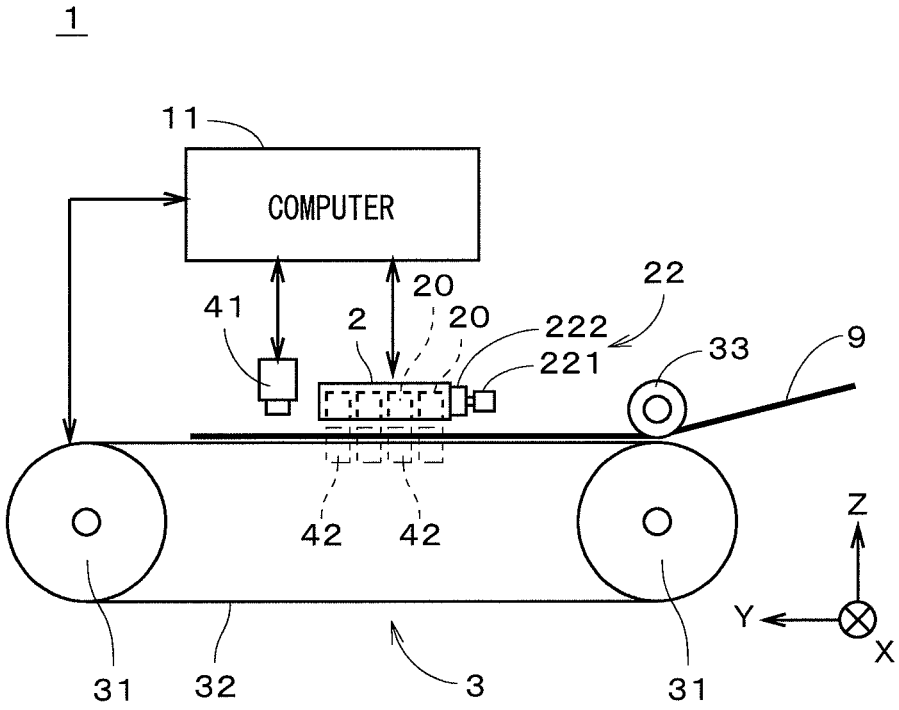
FIG. 1 illustrates a configuration of an inkjet printer.

FIG. 1 shows a configuration of an inkjet printer 1 according to an embodiment of the present invention. The inkjet printer 1 is an image recording apparatus that records images of a plurality of color components on printing paper 9 that is continuous paper so as to superimpose the images. The inkjet printer 1 includes an ejection part 2 that ejects fine droplets of ink toward the printing paper 9, an ejection part moving mechanism 22 for moving the ejection part 2 in the X direction in FIG. 1, a paper feed mechanism 3 for moving the printing paper 9 in the Y direction perpendicular to the X direction under the ejection part 2, an image pickup part 41 that is disposed close to the (+Y) side of the ejection part 2, and a computer 11 that is connected to the ejection part 2, the ejection part moving mechanism 22, the paper feed mechanism 3, and the image pickup part 41. Hereinafter, the direction of movement of the printing paper 9 (i.e., Y direction) is referred to as a "scanning direction", and the direction perpendicular to the scanning direction and along the printing paper 9 (i.e., X direction, or the direction corresponding the width of the printing paper 9) is referred to as a "width direction".

The paper feed mechanism 3 includes two belt rollers 31 that are connected to a motor not shown, and a belt 32 that runs between the two belt rollers 31. The printing paper 9 is guided and held on the belt 32 through a roller 33 that is provided above the belt roller 31 on the (−Y) side and is moved to the (+Y) side, passing through under the ejection part 2 together with the belt 32.

The image pickup part 41 is a line sensor having a plurality of light receiving elements (e.g., charge coupled devices (CCDs)) arranged in the width direction, and is capable of capturing an image printed on the printing paper 9 (printed image) by the light receiving elements outputting line image data in synchronization with the movement of the printing paper 9 in the scanning direction. An area sensor having a plurality of light receiving elements arrayed two-dimensionally may be used as the image pickup part 41.

The ejection part moving mechanism 22 is provided with a timing belt 222 having a long, thin annular shape extending in the width direction. By the motor 221 circulating the timing belt 222, the ejection part 2 smoothly moves in the width direction.

The ejection part 2 has a plurality of (in FIG. 1, four) head units 20 arranged in the scanning direction, the head units 20 ejecting inks of different colors. While the following description focuses on only one of the head units 20 that ejects ink of one color, the other head units 20 also have the same configuration and perform similar operations.

Figure 2:
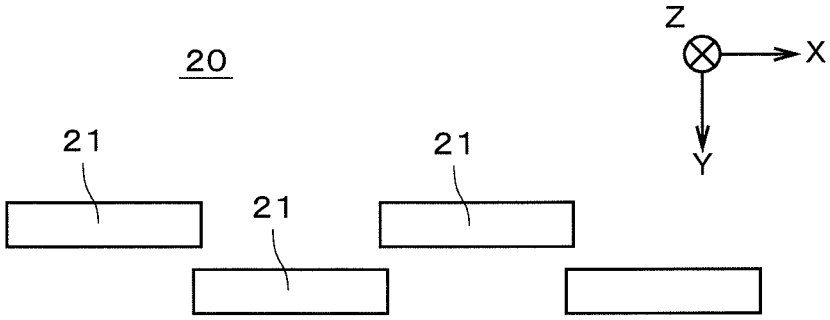
FIG. 2 is a bottom view of a head unit.

FIG. 2 is a bottom view of part of a head unit 20. In FIG. 2, the head unit 20 is illustrated assuming that the scanning direction in FIG. 1 is the vertical direction. The head unit 20 in FIG. 2 has a plurality of heads 21 arranged in a staggered manner in the width direction. In actuality, the heads 21 are arranged across the entire width of the printing paper 9 in the width direction and realize so-called one-pass (single-pass) printing in which printing is completed in one pass of the printing paper 9 under the ejection part 2.

Figure 3:
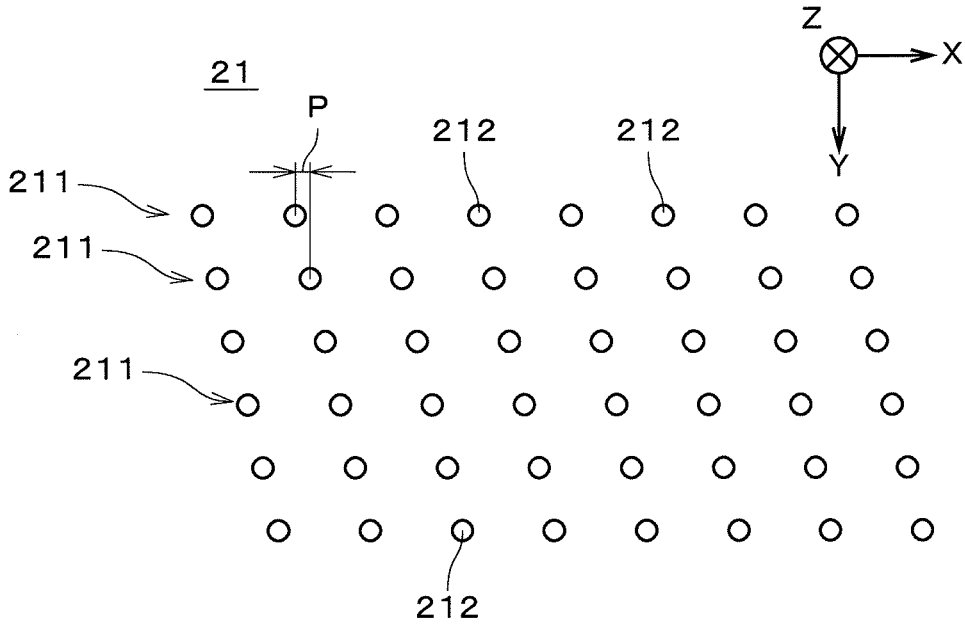
FIG. 3 is a bottom view of a head.

FIG. 3 is an enlarged bottom view illustrating part of one of the heads 21. As shown in FIG. 3, each head 21 has a plurality of (in FIG. 3, six) outlet rows 211 aligned in the scanning direction (Y direction). Each outlet row 211 is a group of a plurality of outlets 212 that are arranged at a fixed pitch in the width direction (X direction). With respect to the width direction, outlets 212 that are adjacent to each other in each outlet row 211 have disposed therebetween one outlet 212 from each of the other outlet rows 211 (i.e., the one outlet 212 is disposed between the outlets 212.). That is, when focusing on only the width direction, the head 21 as a whole has arranged therein a plurality of outlets 212 at a pitch P (hereinafter referred to as an "outlet pitch P") that is one-nth the fixed pitch, where n is the number of outlet rows 211. The plurality of outlets 212 in the head 21 are disposed on the same plane that is parallel to the main surface of the printing paper 9 under the ejection part 2 (i.e., parallel to the XY plane).

When the inkjet printer 1 in FIG. 1 is not performing printing, the ejection part 2 is disposed at a predetermined retracted position by the ejection part moving mechanism 22, and the outlets 212 are blocked off with a lid member at the retracted position. Suction mechanisms 42 (indicated by rectangles outlined with dashed double-dotted lines in FIG. 1) that are capable of sucking ink from the outlets 212 of the heads 21 are provided in the vicinity of the retracted positions of the respective head units 20. The suction mechanisms 42 each include, for example, two suction parts that are disposed respectively at the same positions as the heads 21 on the (+Y side) and the heads 21 on the (−Y side) in the scanning direction in FIG. 2. Each suction part has a size that covers all the outlets 212 of a single head 21, and by disposing an arbitrary head 21 above a suction part, it is possible to implement cleaning processing for sucking ink from all of the outlets 212 included in the head 21. Note that the suction mechanisms 42 may have another configuration. For example, a configuration is possible in which a suction mechanism 42 is provided with a single suction part and a mechanism for moving the suction mechanism 42 in the scanning direction is provided so that cleaning processing is executed for each head 21, using the single suction portion.

Figure 4:
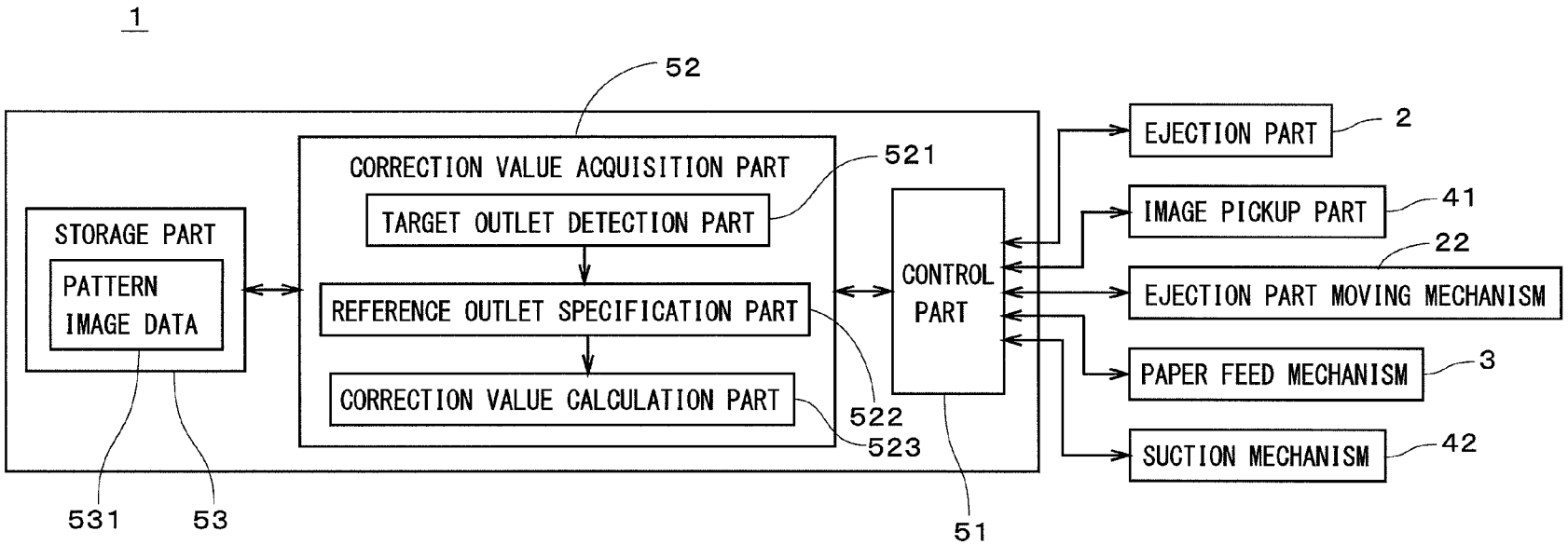
FIG. 4 is a block diagram showing a functional configuration of the inkjet printer.

FIG. 4 is a block diagram showing a functional configuration of the inkjet printer 1, and a control part 51, a correction value acquisition part 52, and a storage part 53 in FIG. 4 are functions realized by the computer 11. The control part 51 performs overall control of the inkjet printer 1 and controls ink ejection from the heads 21 in synchronization with the continuous movement of the printing paper 9 in the scanning direction so that the outlets 212 form dots at a plurality of positions in the width direction on the printing paper 9.

The correction value acquisition part 52 includes a target outlet detection part 521, a reference outlet specification part 522, and a correction value calculation part 523. The storage part 53 stores various types of information. The function of the correction value acquisition part 52 will be described later in detail. Note that the functions of the control part 51, the correction value acquisition part 52, and the storage part 53 may be constructed by dedicated electric circuits, or part of these functions may be implemented using dedicated electric circuits.

Here, basic operations performed when printing an image on the printing paper 9 will be described. The control part 51 prepares original image data that indicates an image to be printed (hereinafter referred to as an "original image") and a threshold matrix. In the original image, a plurality of pixels are arranged in both a column direction and a row direction that correspond respectively to the scanning direction and the width direction. Similarly, in the threshold matrix, a plurality of elements are arranged in both the column direction and the row direction that correspond respectively to the scanning direction and the width direction. A plurality of pixels arranged in the row direction in the original image (and a plurality of elements arranged in the row direction in the threshold matrix) are associated respectively with a plurality of outlets 212 in the head unit 20 (i.e., a plurality of pixel positions in the row direction correspond respectively to a plurality of outlets 212). Conceptually, the original image and the threshold matrix are overlaid on each other, and when the pixel value of each pixel in the original image is larger than the element value of the corresponding element at the same position in the threshold matrix, a dot is formed on the printing paper 9 with ink that is ejected from the outlet 212 corresponding to that pixel.

In the actual operation of the control part 51, ink ejection from the heads 21 is controlled using density correction values that are set for the respective outlets 212 and will be described later. This enables the inkjet printer 1 to achieve a uniform print density with the outlets 212.

Next, the flow of processing for acquiring the density correction values of the outlets 212 performed by the inkjet printer 1 will be described with reference to FIG. 5. When acquiring the density correction values, first, a predetermined pattern for density correction and a check pattern are printed on the printing paper 9 with all of the outlets 212 of the head unit 20, under the control of the control part 51 (step S11).

Figure 6:
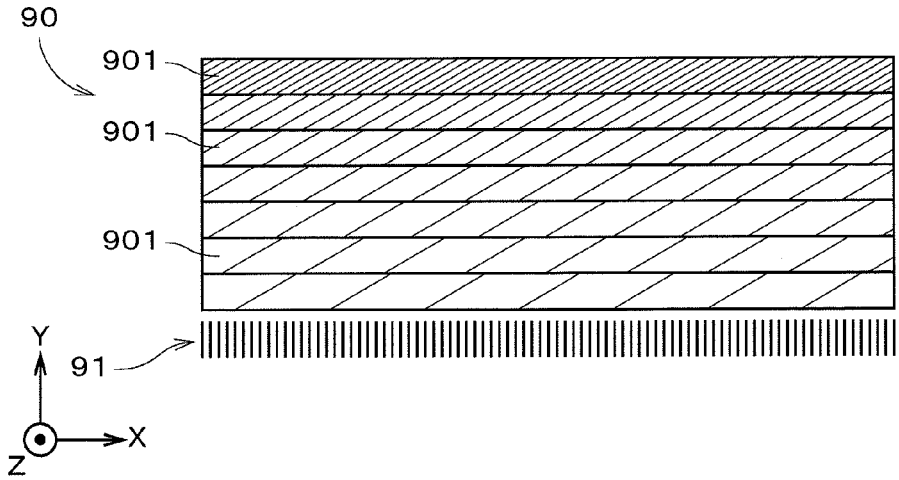
FIG. 6 illustrates a pattern for density correction and a check pattern on printing paper.

FIG. 6 illustrates a pattern for density correction (density correction pattern) 90 and a check pattern 91. The density correction pattern 90 (also called a "step chart") includes a plurality of band-like pattern elements 901 that extend substantially across the entire width of a print region on the printing paper 9, the pattern elements 901 being aligned in the scanning direction (Y direction). Each pattern element 901 is a printed image that has substantially a constant density and is printed by comparing an image having a fixed pixel value and the threshold matrix. The pattern elements 901 have different densities from one another. In the example of FIG. 6, the uppermost pattern element 901 on the (+Y) side has a maximum density, and the other pattern elements 901 have gradually decreasing densities as they are located further away in the (−Y) direction from that pattern element 901. In FIG. 6, density differences are represented by changing the distance between diagonal parallel lines assigned to the pattern elements 901. The check pattern 91 is printed on the (−Y) side (or (+Y) side) of the density correction pattern 90.

Figure 7:
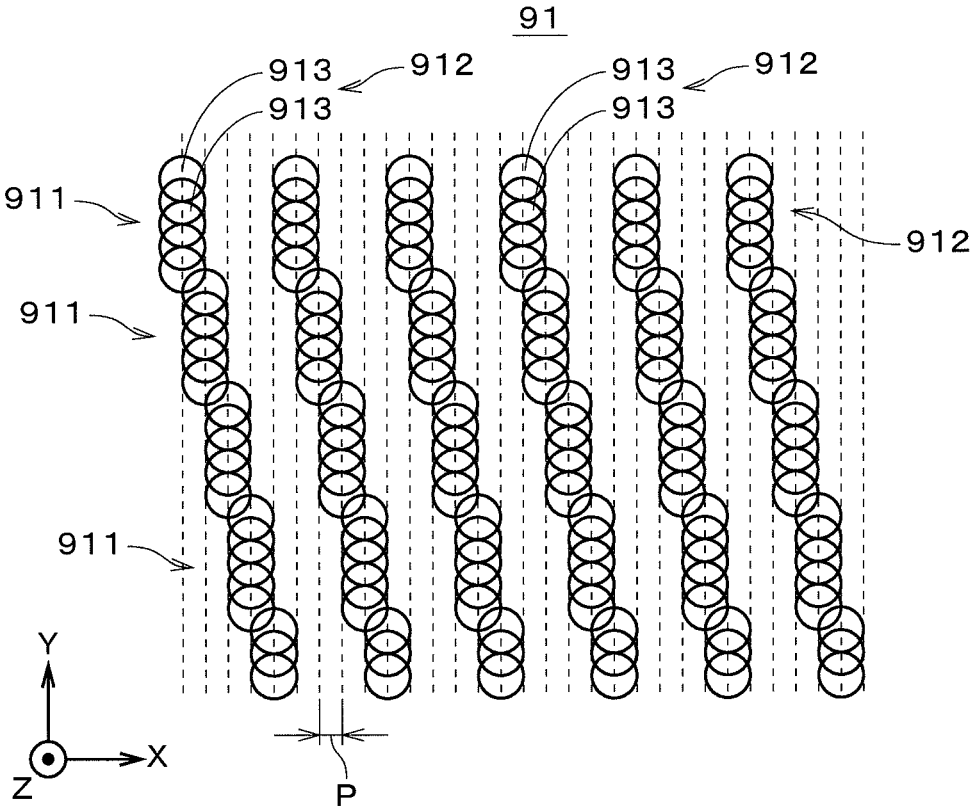
FIG. 7 is an enlarged view of the check pattern on the printing paper.

FIG. 7 is an enlarged view of part of the check pattern 91 on the printing paper 9. In FIG. 7, the position of each outlet 212 in the width direction (hereinafter referred to as an "outlet position") is indicated by a thin broken line extending in the scanning direction (the same applies to the upper section of FIG. 8, which will be described later). As shown in FIG. 7, the check pattern 91 includes a plurality of linear portions 912, each extending in the scanning direction. To be specific, m linear portion rows 911 (where m is an integer of 2 or more), each having linear portions 912 arranged in the width direction, are arranged in the scanning direction, and when referring to each pair of adjacent linear portion rows 911 in the scanning direction, the linear portion row 911 on the (+Y) side is displaced by the outlet pitch P (corresponding to the distance between outlet positions) toward the (−X) side from the linear portion row 911 on the (−Y) side. In each linear portion row 911, the linear portions 912 are arranged at a pitch that is m times the outlet pitch P in the width direction. Accordingly, in the check pattern 91, each linear portion 912 is not in contact with any other linear portions 912 in the width direction, and a plurality of linear portions 912 are arranged at the outlet pitch P with respect to the width direction.

The plurality of linear portions 912 are disposed at the same positions in the width direction as the plurality of outlets 212 included in the head unit 20 (i.e., disposed at the outlet positions), and each linear portion 912 is formed with the ink ejected from the outlet 212 disposed at the same position in the width direction. In actuality, each linear portion 912 is a group of a plurality of dots 913 arranged in the scanning direction, and the diameter of each dot 913 on the printing paper 9 is greater than the outlet pitch P.

The density correction pattern 90 and the check pattern 91 on the printing paper 9 are captured by the image pickup part 41, so that image data indicating the density correction pattern 90 and the check pattern 91 (hereinafter referred to as "pattern image data") is acquired (step S12). That pattern image data 531 is input to the computer 11 and stored in the storage part 53 in preparation.

Figure 8:
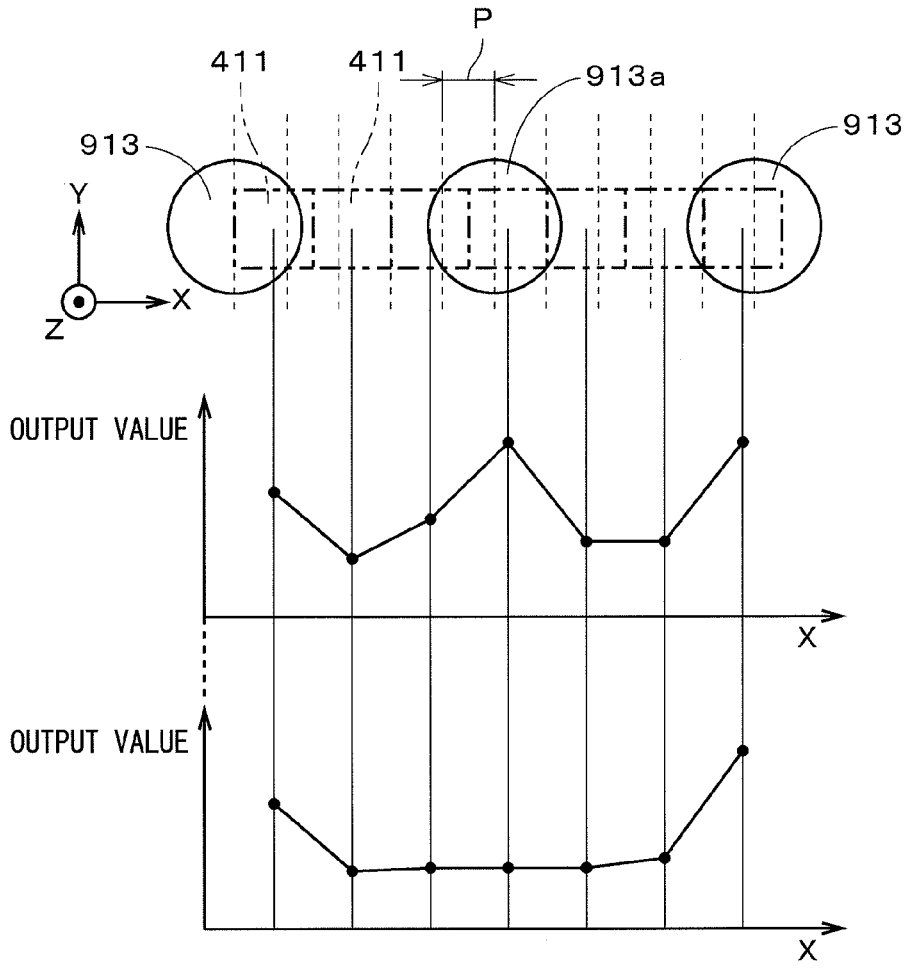
FIG. 8 illustrates the relationship between dots on printing paper and light receiving elements.

FIG. 8 illustrates the relationship between dots 913 formed on the printing paper 9 and light receiving elements of the image pickup part 41. The upper section of FIG. 8 illustrates dots 913 formed at a single position in the scanning direction on the printing paper 9, and furthermore, the dashed double-dotted lines indicate regions 411 on the printing paper 9 in which output values are acquired by the respective light receiving elements of the image pickup part 41 when acquiring one line's worth of image data (i.e., regions on the printing paper 9 onto which the light receiving elements are projected). The middle section of FIG. 8 illustrates the output values acquired by the light receiving elements, and the lower section of FIG. 8 illustrates the output values acquired by the light receiving elements in the case where a dot 913*a* in the center of the upper section of FIG. 8 has not been formed. As shown in the upper section of FIG. 8, in the present embodiment, the width of each region 411 corresponding to a single light receiving element on the printing paper 9 is greater than the outlet pitch P in the head unit 20. Also, as shown in the middle and lower sections of FIG. 8, the output value (output density value) increases as the range of each light receiving element that overlaps with a dot in the width direction increases.

Next, the target outlet detection part 521 obtains an evaluation value that indicates the extent to which each linear portion 912 is missing, based on the pattern image data 531. To be specific, in the image indicated by the pattern image data 531, an average value of pixel values (output values of light receiving elements) in a rectangular region that is slightly larger than the size of each linear portion 912 (the size in the case where there is no missing part) and surrounds the entire linear portion 912 is acquired as an evaluation value of the linear portion 912. The evaluation value of each linear portion 912 is compared with a predetermined threshold value, and a linear portion 912 whose evaluation value is lower than or equal to the threshold value is specified as a linear portion 912 that is partly or entirely missing (hereinafter referred to as a "missing linear portion 912"). Then, an outlet 212 that is disposed at the same position as the missing linear portion 912 in the width direction is detected as a target outlet 212 (step S13). Also, an outlet 212 that is disposed at an outlet position adjacent on the (+X) side of the outlet position of the target outlet 212 and an outlet 212 that is disposed at an outlet position adjacent on the (−X) side are also detected as target outlets 212.

When the plurality of target outlets 212 have been detected, the reference outlet specification part 522 specifies, for each target outlet 212, three outlets 212 adjacent on the (+X) side of the target outlet 212 and three outlets 212 adjacent on the (−X) side thereof, for example, as reference outlets 212 from among the plurality of outlets 212 included in the same outlet row 211 as the target outlet 212 (step S14). Note that the number of reference outlets 212 specified for each target outlet 212 may be determined arbitrarily.

Then, the correction value calculation part 523 obtains a density value at each outlet position in each pattern element 901 based on the pattern image data 531 (step S15). For example, an average value of pixel values of pixels (output values of light receiving elements) arranged in the direction corresponding to the scanning direction (i.e., the arrangement direction of the pattern elements 901) in the image of each pattern element 901 indicated by the pattern image data 531 is obtained as a density value at each pixel position in the width direction. Through this, a density profile that indicates a change in density values in the width direction of the pattern element 901 is acquired. Then, in the density profile, an average value of the density values at a predetermined number of pixel positions with each outlet position at the substantial center (in the example of FIG. 8, an average value of the density values at three pixel positions because three regions 411 span the entire width of a single dot 913) is acquired as a density value at that outlet position.

When a density value at each outlet position has been acquired, a value obtained by dividing a reference density value that is set in advance for each pattern element 901 by the acquired density value is obtained as a density correction value of the outlet 212 located at that outlet position (step S 16). In the present embodiment, a smaller density correction value is acquired as the density value of the outlet position in the density profile increases. However, as will be described later, since density correction in the inkjet printer 1 can be implemented using various methods, the density correction values may be obtained through various calculations based on the ratio or difference between each density value and a predetermined reference density value (or an average value of density values, etc.) (the same applies to step S 17*a* in FIG. 10, which will be described later).

Figure 9:
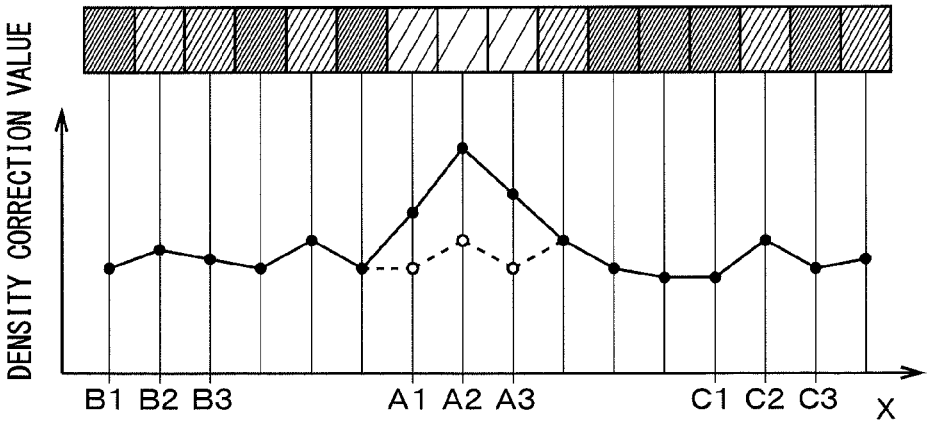
FIG. 9 illustrates the density value and the density correction value at each outlet position.

FIG. 9 illustrates the density value and the density correction value at each outlet position. The upper section of FIG. 9 illustrates a change in density values at a plurality of outlet positions arranged in the width direction (X direction) by changing the distance between diagonal parallel lines that are assigned to a plurality of rectangular regions arranged in the lateral direction in FIG. 9. Here, a narrower distance between the parallel diagonal lines indicates a higher density value. The lower section of FIG. 9 illustrates a change in the density correction values of a plurality of outlet positions arranged in the width direction, with the outlet positions of a plurality of target outlets 212 being indicated by A1 to A3 and the outlet positions of reference outlets 212 specified for the respective target outlets 212 being indicated by B1 to B3 and C1 to C3. To be specific, the reference outlets 212 at the outlet positions B1 and C1 are specified for the target outlet 212 at the outlet position A1, the reference outlets 212 at the outlet positions B2 and C2 are specified for the target outlet 212 at the outlet position A2, and the reference outlets 212 at the outlet positions B3 and C3 are specified for the target outlet 212 at the outlet position A3.

The correction value calculation part 523 further obtains an average value of the density correction values of the plurality of reference outlets 212 for each target outlet 212 and replaces the density correction value of the target outlet 212 with the obtained average value (step S 17). In the lower section of FIG. 9, the density correction values of the target outlets 212 that have been replaced are indicated by white circles. Through this, a plurality of final density correction values of the plurality of outlets 212 are acquired for each pattern element 901. The density correction value of each target outlet 212 may be another representative value (e.g., median value) that indicates the vicinity of the center of the range in which the density correction values of the plurality of reference outlets 212 are distributed, rather than the average value of these density correction values.

Here, it has been confirmed that, in a head 21 having a plurality of outlet rows 211, the variation in dot size between the plurality of outlets 212 included in the same outlet row 211 is less than the variation in dot size between the plurality of outlet rows 211, and that the outlets 212 included in the same outlet row 211 (in particular, those that are disposed close to each other) form dots of substantially the same size. Accordingly, by correcting the density correction values of the target outlets 212 based on the density correction values of the reference outlets 212, appropriate density correction values can be acquired for all of the outlets 212. As described above, the feature that the outlets included in the same outlet row form dots of substantially the same size is considered to be due to, for example, the fact that the level of the driving signal used in the ink ejection operation can be adjusted for each outlet row 211, and to reasons related to manufacture of the head 21.

As previously described, since the density correction pattern 90 includes a plurality of pattern elements 901 corresponding respectively to a plurality of densities, a plurality of density correction values are obtained for respective outlets 212. The correction value calculation part 523 assigns, to each of a plurality of density ranges that are obtained by dividing the entire density range that the printed image can take (a plurality of density ranges that respectively include the densities of the plurality of pattern elements 901), density correction values that have been derived from a pattern element 901 that has a density included in that density range, and prepares a correction table that indicates the density correction values for the respective density ranges for each outlet 212.

When a plurality of density correction values have been obtained for each outlet 212 through the above-described processing, these density correction values (correction table) are input to and set in the control part 51 (step S18). When printed material is created with the inkjet printer 1, it is assumed that, in principle, there are no outlets 212 where an ink ejection failure has occurred. Thus, in the case where target outlets 212 have been detected as described above, cleaning processing by the suction mechanism 42 is performed in advance on a head 21 that includes the target outlets 212. In the present embodiment, cleaning processing on the head 21 including the target outlets 212 is automatically performed after the processing of step S18. Alternatively, the cleaning processing on the head 21 may be performed based on a user instruction to perform cleaning processing (i.e., instructed manually). Then, during actual creation of the printed material, the control part 51 controls ink ejection from the head 21 using a plurality of density correction values.

Specifically, an original image to be printed is corrected by multiplying the pixel values of a plurality of pixels that are arranged in the column direction at each position in the row direction by the density correction value of the outlet 212 corresponding to that position. To be more specific, the density correction value that corresponds to a density range to which the pixel value of each pixel belongs is specified by referencing the correction table, and the pixel value of this pixel is multiplied by that density correction value. Then, the corrected original image and the threshold matrix are compared so as to determine whether or not to form a dot at each position on the printing paper 9 and to thereby control ink ejection from each outlet 212. Alternatively, the threshold matrix may be corrected using the density correction values. Specifically, the threshold matrix is corrected by dividing the element values of a plurality of elements that are arranged in the column direction at each position in the row direction by the density correction value of the outlet 212 corresponding to that position. Then, the original image and the corrected threshold matrix are compared so as to control ink ejection from each outlet 212. Furthermore, the control part 51 may correct the amount of ink ejected from each outlet 212 when forming a single dot, using the density correction value.

As described previously, since a target outlet 212 is an outlet 212 that ejects ink toward a missing linear portion 912, (there is a high possibility that) a linear region that extends in the scanning direction and has a missing part in part or in whole appears at the outlet position of the target outlet 212 in each pattern element 901 of the density correction pattern 90. Accordingly, the density correction value acquired for the target outlet 212 in the processing of step S16 is an abnormal value. If, after the ejection failure in the target outlet 212 has been resolved by the cleaning processing, this density correction value is used as is for the target outlet 212, the density at the outlet position of the target outlet 212 will be higher than the density at the other outlet positions in an image to be printed on the printing paper 9. Also, when attempting to acquire the density correction pattern 90 that is printed in a state in which ejection failure has not occurred in any of the outlets 212, a large number of repetitions of the cleaning processing and the printing of the density correction pattern 90 may be required, thus taking a long time to acquire the density correction values.

In contrast, with the inkjet printer 1 in FIG. 1, the reference outlets 212 that are included in the same outlet row 211 as each target outlet 212 and located close to the target outlet 212 are specified, and the density correction value of each target outlet 212 among the density correction values that are acquired based on the density profile of the density correction pattern 90 is replaced with the representative value of the density correction values of the corresponding reference outlets 212. Thus, even if an ink ejection failure occurs in any of the outlets, appropriate density correction values of a plurality of outlets (i.e., density correction values that can achieve a uniform print density) can be acquired in a short time by taking advantage of the feature that the outlets included in the same outlet row (in particular, those that are disposed close to each other) form dots of substantially the same size. As a result, it is possible to prevent unevenness of density in the printed image.

Furthermore, since in the inkjet printer 1, the width of each region 411 corresponding to a single light receiving element on the printing paper 9 is greater than the outlet pitch P and the diameter of each dot 913 is greater than the outlet pitch P, the density values in regions that are adjacent to a missing linear region in the density correction pattern 90 will be affected by the linear region. However, with the inkjet printer 1, outlets 212 that eject ink toward the regions adjacent to the missing linear region are detected as other target outlets 212. Thus, even if the acquisition of the density values in the regions adjacent to the linear region is affected by the linear region, appropriate density correction values can be acquired for the outlets that eject ink toward these regions.

The control part 51 of the inkjet printer 1 may store, for each target outlet 212, both the density correction value acquired in the processing of step S16 (i.e., the density correction value before replacement) and the density correction value acquired in the processing of step S17 (i.e., the density correction value after replacement). With such an inkjet printer 1, the density correction value before replacement is used for a target outlet 212 until the execution of the cleaning processing and in the case where the ink ejection failure in the target outlet 212 has not been resolved by the execution of the cleaning processing, and the density correction value after replacement is used for the target outlet 212 in the case where the ink ejection failure in the target outlet 212 has been resolved after the execution of the cleaning processing. Note that whether or not an ink ejection failure has been resolved can be determined by printing a check pattern 91 and acquiring the evaluation values of the linear portions 912, similarly to the above-described processing.

Figure 10:
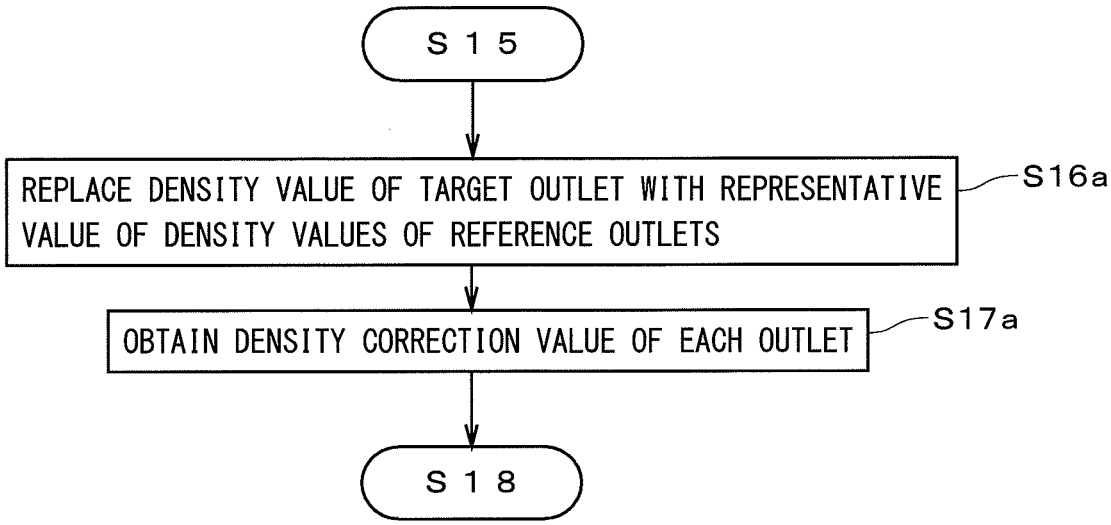
FIG. 10 is a flowchart of part of the processing for acquiring density correction values.

Next is a description of another example of processing performed by the correction value calculation part 523. FIG. 10 illustrates a part of the flow of processing for acquiring the density correction values of a plurality of outlets 212, performed by the inkjet printer 1, i.e., processing performed between steps S15 and S18 in FIG. 5. In the correction value calculation part 523, as described above, when the density value at each outlet position in each pattern element 901 has been obtained (step S15 in FIG. 5), the outlet positions of a plurality of reference outlets 212 are specified for each target outlet 212 and a representative value (e.g., average value) of the density values at the outlet positions of the reference outlets 212 is obtained. Then, the density value of the target outlet 212 is replaced with that representative value (step S 16*a*). In this way, in the pattern element 901, the density value of a missing linear region that is produced by the ink ejection failure in each target outlet 212 is replaced with a representative value of the density values at the positions in the width direction at which the reference outlets 212 corresponding to the target outlet 212 eject ink, and a density profile that has been corrected is acquired.

Thereafter, the density correction value of each outlet 212 is obtained based on the corrected density profile (step S17*a*). In the present exemplary processing, an average value of a predetermined number of density values that are calculated at each outlet position and outlet positions in the vicinity of that outlet position in the density profile is obtained as a new density value at each outlet position. Then, a value obtained by dividing a reference density value that is set in advance for each pattern element 901 by the new density value at each outlet position is obtained as a density correction value of the outlet 212 at that outlet position. A plurality of density correction values (correction table) obtained for each outlet 212 are input to and set in the control part 51 (step S18 in FIG. 5).

As described above, the correction value calculation part 523 acquires a density profile in which the density value of a missing linear region caused by the ink ejection failure in each target outlet 212 is replaced with a representative value of the density values at the outlet positions at which the corresponding reference outlets 212 eject ink, and obtains a plurality of density correction values of a plurality of outlets 212 based on the density profile. Accordingly, even if an ink ejection failure occurs in any of the outlets, appropriate density correction values can be acquired in a short time without performing cleaning processing.

Furthermore, even in the case where the density values at a position in the width direction at which each outlet 212 ejects ink and positions in the vicinity of that position are used when obtaining the density correction value of the outlet 212, since the density value at the outlet position of each target outlet 212 is corrected in the density profile, appropriate density correction values can be acquired without an abnormal density value adversely affecting density correction values at neighboring outlet positions.

Figure 5:
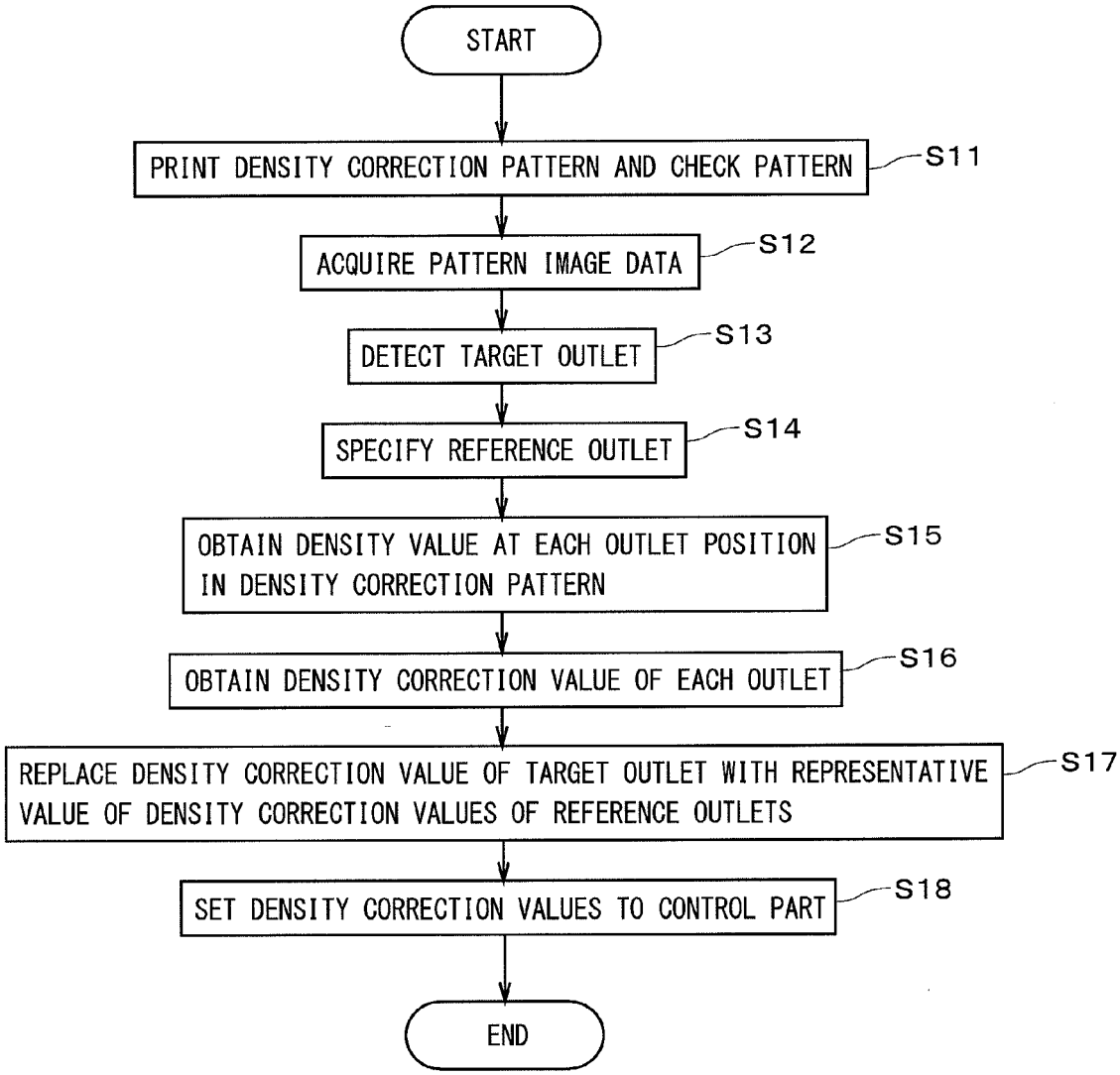
FIG. 5 is a flowchart showing the flow of processing for acquiring density correction values.

In a preferable inkjet printer 1, for example, the processing of steps S11 to S18 in FIG. 5 is continuously repeated by the control part 51. At this time, the plurality of density correction values that have been acquired when printing one density correction pattern 90 are used to print the next density correction pattern, and the correction value acquisition part 52 updates the plurality of density correction values of the plurality of outlets 212 based on image data that indicates the next density correction pattern. In actuality, more preferable density correction values are acquired by repeating the processing of steps S11 to S18 until the variation in density values (except those at the outlet positions of the target outlets 212) in each pattern element 901 of the density correction pattern 90 printed on the printing paper 9 is a predetermined value or less. With the inkjet printer 1 in which the density correction value (or density value) of each target outlet 212 is replaced with a representative value of the density correction values (or density values) of the reference outlets 212, it is possible, by repeating the printing of the density correction pattern 90 and the acquisition of density correction values, to efficiently perform processing for acquiring more preferable density correction values without performing cleaning processing. Note that, if each density correction pattern 90 is used to acquire density correction values, cleaning processing may be performed after printing of one density correction pattern 90 and before printing of the next density correction pattern 90.

While the above has been a description of embodiments of the present invention, the present invention is not intended to be limited to the above-described embodiments, and can be modified in various ways.

While in the above-described embodiments, a plurality of reference outlets 212 are specified for each target outlet 212, if the variation in dot size between a plurality of outlets 212 in the same outlet row 211 is extremely small, only a single reference outlet 212 may be specified for each target outlet 212. In other words, the reference outlet specification part 522 specifies at least one reference outlet 212 that is included in the same outlet row 211 as a target outlet 212 and disposed close to the target outlet 212.

While, in the inkjet printer 1, printing the check pattern 91 in FIG. 7 together with the density correction pattern 90 enables accurate detection of the target outlets 212 based on the extent to which each linear portion 912 is missing, a target outlet 212 to be detected may, for example, be an outlet 212 that is disposed at an outlet position at which the density correction value is extremely high (the density correction value is higher than a predetermined threshold value) in a change in density correction values with the outlet positions illustrated in the lower section of FIG. 9, or an outlet 212 that is disposed at an outlet position at which the density value is extremely small in the density profile of the density correction pattern 90 in the width direction. In this case, the check pattern 91 in FIG. 7 can be omitted.

The density correction pattern 90 may be a pattern that indicates only a single constant density image (pattern element 901). In this case, a single density correction value is acquired for each outlet 212. Then, this single density correction value is used to correct the pixel values of pixels corresponding to the outlet 212 in the original image, the element values of elements in the threshold matrix, or the amount of ink ejected from the outlet 212.

The cleaning processing performed by the inkjet printer 1 may be other kind of processing rather than sucking ink from outlets 212 using the suction mechanism 42. For example, processing for vigorously ejecting ink from each head 21 while increasing pressure applied to ink higher than in the normal operating state, processing for rubbing the surface of each head 21 in which the outlets 212 are formed with another member, or the like may be executed as cleaning processing.

In each outlet row 211, a plurality of outlets 212 may be arranged in an arrangement direction that is inclined with respect to the width direction. It is sufficient for the arrangement direction of the outlets 212 to intersect with the scanning direction. In this case, a plurality of outlet rows 211 are arranged in a direction perpendicular to the arrangement direction of the outlets 212.

While in the inkjet printer 1, the printing paper 9 is moved relative to the ejection part 2 in the scanning direction by the paper feed mechanism 3 serving as a scanning mechanism, a scanning mechanism for moving the ejection part 2 in the Y direction may be provided. A configuration is also possible in which the printing paper 9 is held by a roller and moved in the scanning direction relative to the ejection part 2 by a motor that rotates the roller. In this way, a scanning mechanism for moving the printing paper 9 relative to the ejection part 2 in the scanning direction can be implemented with various configurations.

The inkjet printer may be configured to print an image on printing paper in sheet form. For example, in an inkjet printer that holds printing paper on a stage, the width of the ejection part in the width direction is made narrower than the print area of the printing paper, and a scanning mechanism is provided for moving the ejection part relative to the printing paper in both the scanning direction and the width direction. Then, the ejection part is moved relative to the printing paper in the scanning direction while ejecting ink (main scanning), is moved relative to the printing paper by a predetermined distance in the width direction after having reached the edge of the printing paper (sub-scanning), and is thereafter moved in a direction opposite to the previous main scanning performed in the scanning direction relative to the printing paper while ejecting ink. In this way, with the above-described inkjet printer (so-called "shuttle printer"), an image is printed on the entire printing paper by the ejection part moving relative to the printing paper in the scanning direction for main scanning, and every time the main scanning is complete, intermittently moving in the width direction for sub-scanning.

The image pickup part 41 may have a mechanism for moving a group of light receiving elements in the X direction and be configured to capture an image on the printing paper 9 in association with the movement of the group of light receiving elements in the X direction. An object to be printed by the inkjet printer 1 may be a base material other than the printing paper 9 and may, for example, be a plate- or film-like base material made of plastic or the like.

The configurations of the above-described embodiments and variations may be appropriately combined as long as there are no mutual inconsistencies.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2012-036320 filed in the Japan Patent Office on Feb. 22, 2012, the entire disclosure of which is incorporated herein by reference.

REFERENCE SIGNS LIST

1 Inkjet printer
3 Paper feed mechanism
9 Printing paper
21 Head
41 Image pickup part
51 Control part
52 Correction value acquisition part
90 Density correction pattern
91 Check pattern
211 Outlet row
212 Outlet
521 Target outlet detection part
522 Reference outlet specification part
523 Correction value calculation part
531 Pattern image data
912 Linear portion
913, 913*a* Dot
S11 to S18, S16*a*, S17*a* Step

The invention claimed is:

1. An inkjet printer comprising:

a head in which a plurality of outlet rows, each having outlets arranged in an arrangement direction, are arranged in a direction perpendicular to said arrangement direction;

a scanning mechanism that moves a base material relative to said head in a scanning direction that intersects with said arrangement direction;

a control part that controls ink ejection from said head so that a plurality of outlets of said head form dots at a plurality of positions in a width direction on a base material, said width direction being perpendicular to said scanning direction, outlets that are adjacent to each other in each outlet row having disposed therebetween one outlet from each of the other outlet rows with respect to said width direction;

an image pickup part that captures an image printed on a base material; and a correction value acquisition part that acquires a plurality of density correction values of said plurality of outlets, wherein, under control of said control part, a pattern for density correction that indicates a constant-density image is printed on a base material with said plurality of outlets, said image pickup part acquires image data that indicates said pattern for density correction on said base material, and said correction value acquisition part includes:

a target outlet detection part that detects a target outlet based on said image data, said target outlet being an outlet that ejects ink toward a linear region that extends in said scanning direction and has a missing part in said pattern for density correction on said base material;

a reference outlet specification part that specifies at least one reference outlet that is an outlet included in the same outlet row as said target outlet and located close to said target outlet; and a correction value calculation part that obtains said plurality of density correction values that are used by said control part to control ink ejection from said head by replacing a density correction value of said target outlet among density correction values that are acquired based on a density profile with a representative value of a density correction value of said at least one reference outlet, said density profile indicating a change in density values in said width direction in said density correction pattern, or obtains said plurality of density correction values that are used by said control part to control ink ejection from said head, based on a density profile that is obtained by replacing a density value of said linear region with a representative value of a density value at a position in said width direction at which said at least one reference outlet ejects ink.

2. The inkjet printer according to claim 1, wherein a check pattern having linear portions formed with ink ejected from respective outlets is printed together with said pattern for density correction on said base material, said image data indicating said pattern for density correction and said check pattern on said base material is acquired, and said target outlet detection part detects said target outlet based on an extent to which each linear portion is missing in said check pattern.

3. The inkjet printer according to claim 2, wherein a plurality of density correction values that are acquired when a pattern for density correction is printed are used to print a next pattern for density correction, and said correction value acquisition part updates said plurality of density correction values of said plurality of outlets based on image data that indicates said next pattern for density correction.

4. The inkjet printer according to claim 1, wherein said target outlet detection part detects an outlet that ejects ink toward a region adjacent to said linear region as another target outlet.

5. The inkjet printer according to claim 4, wherein a plurality of density correction values that are acquired when a pattern for density correction is printed are used to print a next pattern for density correction, and said correction value acquisition part updates said plurality of density correction values of said plurality of outlets based on image data that indicates said next pattern for density correction.

6. The inkjet printer according to claim 1, wherein said correction value calculation part replaces the density value of said linear region with the representative value of the density value at the position in said width direction at which said at least one reference outlet ejects ink, and then obtains the density correction value of each outlet using a density value at a position in said width direction at which said each outlet ejects ink and a density value at a position in the vicinity of said position of said each outlet.

7. The inkjet printer according to claim 6, wherein a plurality of density correction values that are acquired when a pattern for density correction is printed are used to print a next pattern for density correction, and said correction value acquisition part updates said plurality of density correction values of said plurality of outlets based on image data that indicates said next pattern for density correction.

8. The inkjet printer according to claim 1, wherein a plurality of density correction values that are acquired when a pattern for density correction is printed are used to print a next pattern for density correction, and said correction value acquisition part updates said plurality of density correction values of said plurality of outlets based on image data that indicates said next pattern for density correction.

9. A correction value acquisition method of acquiring density correction values of a plurality of outlets in an inkjet printer, said inkjet printer comprising:

a head in which a plurality of outlet rows, each having outlets arranged in an arrangement direction, are arranged in a direction perpendicular to said arrangement direction; and a scanning mechanism that moves a base material relative to said head in a scanning direction that intersects with said arrangement direction, with respect to a width direction perpendicular to said scanning direction, outlets that are adjacent to each other in each outlet row having disposed therebetween one outlet from each of the other outlet rows, and a plurality of outlets of said head forming dots at a plurality of positions in said width direction on a base material, said correction value acquisition method comprising the steps of:

a) printing a pattern for density correction that indicates a constant-density image on a base material with said plurality of outlets;

b) capturing said pattern for density correction on said base material and acquiring image data;

c) detecting a target outlet based on said image data, said target outlet being an outlet that ejects ink toward a linear region that extends in the scanning direction and has a missing part in said pattern for density correction on said base material;

d) specifying at least one reference outlet that is an outlet included in the same outlet row as said target outlet and located close to said target outlet; and e) obtaining a plurality of density correction values of said plurality of outlets by replacing a density correction value of said target outlet among density correction values that are acquired based on a density profile with a representative value of a density correction value of said at least one reference outlet, said density profile indicating a change in density values in said width direction in said pattern for density correction, or obtaining said plurality of density correction values based on a density profile that is obtained by replacing a density value of said linear region with a representative value of a density value at a position in said width direction at which said at least one reference outlet ejects ink.

10. The correction value acquisition method according to claim 9, wherein in said step a), a check pattern having linear portions formed with ink ejected from respective outlets is printed together with said pattern for density correction on said base material, in said step b), said image data indicating said pattern for density correction and said check pattern on said base material is acquired, and in said step c), said target outlet is detected based on an extent to which each linear portion is missing in said check pattern.

11. The correction value acquisition method according to claim 10, wherein by repeating said steps a) to e), a plurality of density correction values that are acquired when a pattern for density correction is printed are used to print a next pattern for density correction, and said plurality of density correction values of said plurality of outlets are updated based on image data that indicates said next pattern for density correction.

12. The correction value acquisition method according to claim 9, wherein in said step c), an outlet that ejects ink toward a region adjacent to said linear region is detected as another target outlet.

13. The correction value acquisition method according to claim 12, wherein by repeating said steps a) to e), a plurality of density correction values that are acquired when a pattern for density correction is printed are used to print a next pattern for density correction, and said plurality of density correction values of said plurality of outlets are updated based on image data that indicates said next pattern for density correction.

14. The correction value acquisition method according to claim 9, wherein in said step e), after the density value of said linear region is replaced with the representative value of the density value at the position in said width direction at which said at least one reference outlet ejects ink, the density correction value of each outlet is obtained using a density value at a position in said width direction at which said each outlet ejects ink and a density value at a position in the vicinity of said position of said each outlet.

15. The correction value acquisition method according to claim 14, wherein by repeating said steps a) to e), a plurality of density correction values that are acquired when a pattern for density correction is printed are used to print a next pattern for density correction, and said plurality of density correction values of said plurality of outlets are updated based on image data that indicates said next pattern for density correction.

16. The correction value acquisition method according to claim 9, wherein by repeating said steps a) to e), a plurality of density correction values that are acquired when a pattern for density correction is printed are used to print a next pattern for density correction, and said plurality of density correction values of said plurality of outlets are updated based on image data that indicates said next pattern for density correction.

* * * * *